US005355680A

United States Patent [19]

Darredeau et al.

[11] Patent Number: 5,355,680

[45] Date of Patent: Oct. 18, 1994

[54] PROCESS AND INSTALLATION FOR PRODUCING GASEOUS NITROGEN WITH VARIABLE FLOW RATE

[75] Inventors: Bernard Darredeau, Sartrouville; Maurice Grenier, Paris; Catherine Garnier, Paris; François Venet, Paris, all of France

[73] Assignee: l'Air Liquide, Societe Anonyme pour l'Etude et l'Exploitation des Procedes Georges Claude, Paris, France

[21] Appl. No.: 136,276

[22] Filed: Oct. 15, 1993

[30] Foreign Application Priority Data

Oct. 30, 1992 [FR] France ..... 92 13026

[51] Int. Cl.[5] ..... F25J 3/00

[52] U.S. Cl. ..... 62/21; 62/37; 62/40

[58] Field of Search ..... 62/21, 37, 40

[56] References Cited

U.S. PATENT DOCUMENTS 4,617,040 10/1986 Yoshino ..... 62/37
5,084,081 1/1992 Rohde ..... 62/37
5,157,927 10/1992 Darchis et al. ..... 62/40
5,209,070 5/1993 Darredeau ..... 62/37
5,224,336 7/1993 Agrawal et al. ..... 62/37
5,271,231 12/1993 Ha et al. ..... 62/39

FOREIGN PATENT DOCUMENTS 0107418 5/1984 European Pat. Off. .
0191862 8/1986 European Pat. Off. .
2341110 9/1977 France .

*Primary Examiner*—Ronald C. Capossela
*Attorney, Agent, or Firm*—Young & Thompson

[57] ABSTRACT

In this process of the liquid nitrogen/rich liquid HPN swing type, the connection between the head of the column (4) and the liquid nitrogen holding tank (7) is effected, for the two flow directions of the liquid nitrogen, by a single conduit (12) equipped with a pressure reducing device (13). The direction and the flow rate of the liquid nitrogen flow are controlled by the variations of the pressure of the column, and the holding tanks of liquid nitrogen and rich liquid are maintained at constant pressures.

6 Claims, 1 Drawing Sheet

PROCESS AND INSTALLATION FOR PRODUCING GASEOUS NITROGEN WITH VARIABLE FLOW RATE

Figure 1:
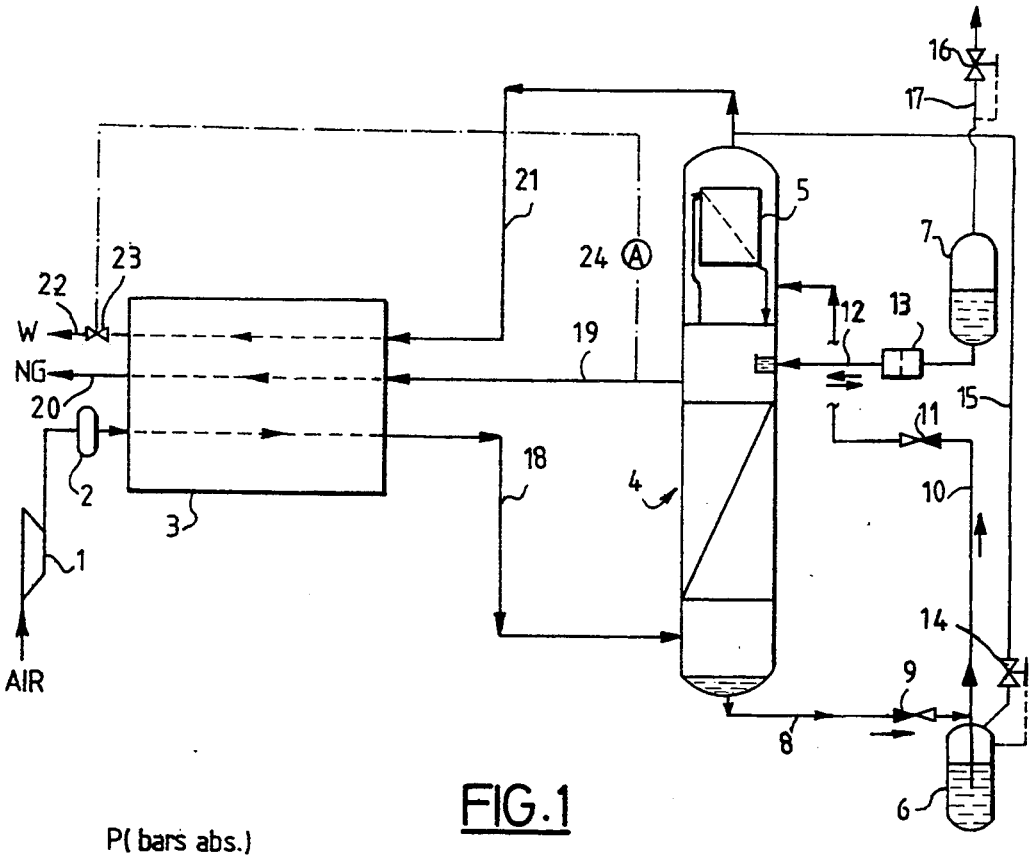

The present invention relates to a process for producing gaseous nitrogen with variable flow rate and a substantially constant composition, of the type in which:

compressed air, purified of water and $CO_2$, is chilled to the vicinity of its dewpoint, and introduced into the sump of a rectification column which produces gaseous nitrogen product at its head and a liquid in its sump, termed rich liquid, consisting of air enriched in oxygen;

a portion of the nitrogen in the head of the column is liquefied by vaporizing rich liquid expanded at a low pressure in a head condenser of the column;

when the gaseous nitrogen demand is greater than the nominal demand, liquid nitrogen is sent to the head of the column from a liquid nitrogen holding tank, and rich liquid is stored in a rich liquid holding tank connected to the sump of the column as well as to the said head condenser; and when the gaseous nitrogen demand is less than the nominal demand, liquid nitrogen is sent from the head of the column to the liquid nitrogen holding tank and the level of rich liquid in the rich liquid holding tank is reduced.

In processes of this type, called "liquid nitrogen/rich liquid HPN swing process", the column and the heat exchange line are dimensioned for a nominal production of gaseous nitrogen. For small installations, preservation of cold conditions is generally assured, in nominal operation, by liquid assist of liquid nitrogen from the liquid nitrogen holding tank toward the head of the column. On the contrary, for large installations, preservation of cold conditions is generally assured by expansion of residual gas (vaporized rich liquid) in a turbine.

For example, to produce 100 $Nm^3/h$ of gaseous nitrogen at 1 vpm (parts per million in vapor phase) of oxygen, it is necessary to compress 240 $Nm^3/h$ of conveyed air, after purification and cooling in the exchange line, in the sump of the column, and to add about 5 $Nm^3/h$ of liquid nitrogen.

For an increased nitrogen demand, the production surplus is taken from the gaseous nitrogen sent to the condenser, such that the flow rate of liquefied nitrogen is less. The reflux of the column is thus reduced, and the number of theoretical plates becomes insufficient to assure the desired composition in the head. It is therefore necessary to send liquid nitrogen to the head of the column to reestablish the reflux which satisfies the desired composition. To reestablish the heat balance, which had been thrown out of balance because cold liquid was sent into the column, rich liquid is sent in an equivalent quantity into the rich liquid holding tank.

For a reduced nitrogen demanded, the excess nitrogen is liquefied in the condenser, such that the reflux increases and the head composition is better than that desired. The reflux is therefore adjusted to the desired composition of the nitrogen in the head by sending the excess liquid to the liquid nitrogen holding tank. The heat balance is reestablished by sending an equivalent quantity of rich liquid from the rich liquid holding tank, to be vaporized in the head condenser of the column.

It is thus necessary to be able to circulate both liquid nitrogen as well as rich liquid in the two directions from the corresponding holding tanks and toward these holding tanks. In the conventional technique, the pressure of the column is always maintained constant. By storing rich liquid at an intermediate pressure between the pressure of the column and the low pressure, no pump is necessary to circulate the rich liquid from the sump of the column to the holding tank and from this latter to the head condenser.

On the other hand, it is necessary to mount two conduits between the head of the column and the liquid nitrogen holding tank, and to equip one of these conduits with a pump, which should be doubled for safety.

The invention has as an object to simplify the known process so as to eliminate any pumps for circulating liquid nitrogen.

To this end, the invention has as an object a process of the type described above, characterized in that liquid nitrogen is caused to pass from the column to the liquid nitrogen holding tank and vice versa, via a single conduit equipped with a pressure reducing device, and the pressures of the liquid nitrogen and rich liquid holding tanks are maintained at constant values.

According to an operational embodiment, the purity of the production nitrogen is surveyed, and if desired this purity is corrected by action of an expansion device for the rich liquid vaporized in the head condenser.

The invention also has as an object an installation designed to practice such a process. This installation, of the type comprising:

means for compressing air;

means for purifying the compressed air of water and $CO_2$;

a rectification column equipped with a head condenser and producing gaseous production nitrogen in the head and a so-called rich liquid in the sump, consisting of air enriched in oxygen;

a heat exchange line for cooling the purified air close to its dewpoint and reheating products exiting from the column;

a rich liquid holding tank, a first conduit equipped with an expansion valve and connecting the sump of the column to this holding tank, and a second conduit equipped with an expansion valve and connecting the rich liquid holding tank to the head condenser; and a liquid nitrogen holding tank, and means for sending liquid nitrogen from the head of the column to this holding tank and vice versa; is characterized in that the head of the column is connected to the liquid nitrogen holding tank by a single connecting conduit equipped with a pressure reducing device, and in that the installation comprises means for maintaining each of the two holding tanks at a constant pressure.

According to other characteristics:

the pressure reducing device is symmetrical relative to the two flow directions in the connecting conduit and is particularly a calibrated orifice, a fixed position manual valve, or a venturi;

the installation comprises an adjustable device for expanding rich liquid vaporized in the head condenser, and an analyzer of the purity of the production nitrogen controlling this expansion device;

the pressure reducing device is asymmetrical relative to the two flow directions in the connecting conduit, and is particularly a convergence followed by a fixed position manual valve.

Figure 2:
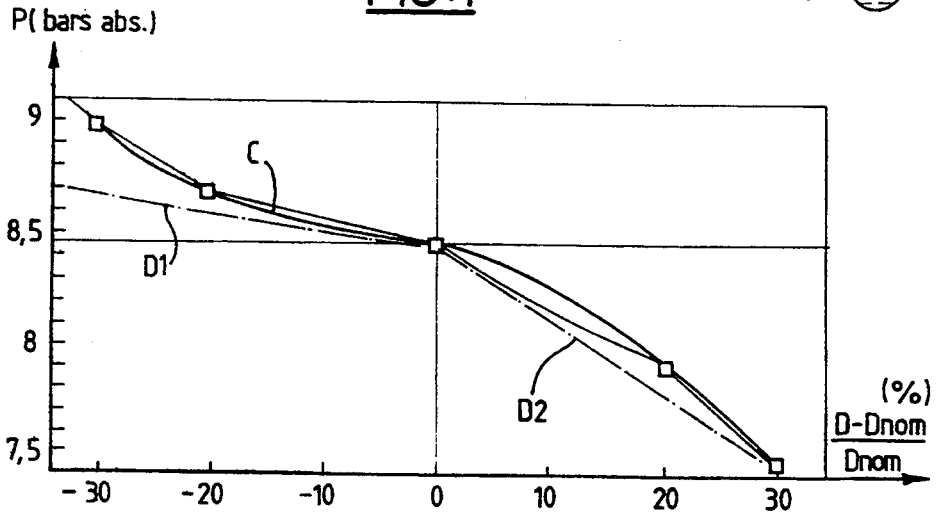

An example of practicing the invention will now be described with reference to the accompanying drawings, in which:

FIG. 1 schematically depicts an installation for producing gaseous nitrogen according to the invention; and FIG. 2 is a diagram illustrating the operation of this installation.

The installation shown in FIG. 1 is designed to produce gaseous nitrogen under pressure on the order of 8 bars absolute, significantly greater than the use pressure. It comprises essentially an air compressor 1, an adsorber 2, a heat exchange line 3, a rectification column 4 equipped with a head condenser 5, a rich liquid holding tank 6 and a liquid nitrogen holding tank 7.

A first conduit 8 equipped with an expansion valve 9 connects the sump of the column to the holding tank 6. A second conduit 10 equipped with an expansion valve 11 connects the bottom of the holding tank 6 to the condenser 5.

In addition, a single connecting conduit 12 equipped with a pressure reducing device 13 connects the bottom of the holding tank 7 to a channel for collecting liquid nitrogen provided in the head of the column 4. The device 13 is symmetrical relative to the two possible directions of flow in the conduit 12; it may be constituted by a calibrated orifice, by a fixed position manual valve, or by a convergence-divergence or venturi.

The holding tank 6 is maintained at a constant pressure comprised between that of the column 4 and that of the condenser 5, by a controlled valve 14 mounted in a conduit 15, which proceeds from the top of the holding tank 6. Likewise, the holding tank 7 is maintained at a constant pressure by an exhaust valve 16 mounted in a conduit 17.

During nominal operation, the air compressed at 1 to about 8 bars absolute is purified of water and $CO_2$ at 2 and cooled at 3 to near its dewpoint, then introduced via a conduit 18 into the sump of the column, where it is separated to form nitrogen to the desired concentration, one part of which is withdrawn from the head of the column via a conduit 19 to be reheated in the heat exchange line and thereafter recovered via a conduit 20 as a product, as well as a "rich liquid" (air enriched in oxygen) which is collected in the sump. The nitrogen not drawn off is condensed in the condenser 5 to provide the reflux of the column. Cooling of this condenser is obtained by sending thereto rich liquid removed from the holding tank 6 via conduit 10 and expanded in the expansion valve 11. The vaporized rich liquid constitutes the residual gas W of the installation and is evacuated from the condenser 5 via a conduit 21 to be reheated in the heat exchange line and thereafter evacuated from the installation by a conduit 22 equipped with a valve 23 having adjustable opening.

During this nominal operation, a slight flow of liquid nitrogen is continuously sent to the head of the column from the holding tank 7, via the conduit 12, to assure that the cold temperature of the installation is preserved. This "baby bottling" is obtained by a reasoned selection of the passage section of the device 13 and of the demand pressure of the valve 16. Specifically, the liquid nitrogen flow in conduit 17 is $$Q = k \times S \times \sqrt{(P1 - P2)}$$

wherein k is a constant characteristic of the device 13 and of the liquid

S is the passage section of the device 13

P1 and P2 are the pressures upstream and downstream of the device 13.

Moreover, the flow rates of rich liquid traversing the valves 9 and 10 are respectively regulated to maintain constant levels in the sump of the column and in the condenser 5.

When the gaseous nitrogen demand becomes greater than the nominal value, a supplementary gas flow is withdrawn from the head of the column. The nitrogen flow rate to the condenser diminishes correspondingly, and therefore also the flow rate of rich liquid vaporized in the condenser 5.

In addition, the increase of the nitrogen demand in the conduits 19 and 20 reduces the pressure of the column, such that an additional flow of liquid nitrogen passes from the holding tank 7 to the head of the column, via the conduit 12 and the pressure reducing device 13.

Overall, this translates to a rise in the level of rich liquid in the holding tank.

If the liquid nitrogen flow is insufficient to compensate the deficit of nitrogen condensed at 5, the reflux of the column does not allow maintaining the purity of the product nitrogen at the desired value. This decrease in purity is detected by an analyzer 24 branched into the conduit 19, which increases the opening of the valve 23 to increase the flow rate of vaporized rich liquid and thereby the flow rate of nitrogen condensed in the condenser 5.

In the case of a larger-sized installation whose cold temperature is preserved not by liquid assist but by expansion of vaporized rich liquid in a turbine, the analyzer would act on the inclination of the blades of this turbine to maintain the purity of the product nitrogen.

Conversely, for similar reasons, when the gaseous nitrogen demand becomes less than the nominal value, the pressure increase in the column has the effect of reducing the liquid nitrogen flow by liquid assist, or, if the lowering of the demand is sufficient, causing liquid nitrogen to pass from the head of the column into the holding tank 7 via the conduit 12 and the device 13. A lowering of the level of rich liquid in the holding tank 6 thereby results.

In this mode of operation, again, the analyzer may act on the opening of the valve 23 (or on the blades of the turbine) to maintain the purity of the product nitrogen at its desired value.

FIG. 2 shows the curve C which is the variation of the column pressure (on the ordinate) as a function of the gaseous nitrogen demand, and more precisely of the ratio (nitrogen flow minus nominal nitrogen flow)/(nominal nitrogen flow)in percent. The "S" shape of the curve is explained considering that, in case of strong nitrogen demand, the pressure reduction explained above promotes distillation, whereas, conversely, in case of weak nitrogen demand, the pressure increase explained above renders distillation more difficult.

As a variation, a simplified adjustment may be adopted that permits continuously obtaining a nitrogen purity greater than or equal to the desired value.

For this, the analyzer 24 is eliminated; a calibrated orifice 23 is used or a valve with fixed opening (or a turbine with fixed blades), and a column having a higher number of plates, sufficient for providing a safety margin to the distillation.

The expansion of vaporized rich liquid in this orifice 23 being sonic, the flow rate of this gas is proportional to the pressure in the condenser 5, which is connected to the pressure of the column by the operation of the condenser.

It is thus possible, by means of an asymmetrical calibrated orifice 13, to obtain two operation straight lines D1, D2 respectively for the nitrogen demands less than and greater than the normal flow, situated entirely below the curve C, and indicated in phantom line in FIG. 2. This guarantees obtaining a nitrogen purity at least equal to the desired value, since a reduction of the column pressure promotes distillation.

Such an asymmetrical orifice 13 may in particular be formed by a convergence of decreasing section toward the column, followed by a manually throttled valve.

In this case, the orifice 23 is preferably constituted by a fixed position manual valve.

In all cases, the conduit 20 is provided with a safety valve (not shown) which is closed in the case of degradation of the purity of the product nitrogen.

So as to eliminate the influence (always slight) of variations of the height of the liquid in the holding tank 7, pressure regulation in this latter may be achieved from the sump pressure of this holding tank. The pressure reducing device 13 may be a vacuum-producing device.

What is claimed is:

1. Process for producing gaseous nitrogen with variable flow rate and a substantially constant composition, comprising:

cooling compressed air purified of water and $CO_2$ to near its dewpoint, and introducing said cooled compressed air into the sump of a rectification column (4) to produce gaseous nitrogen product in the head and a so-called rich liquid in the sump, comprising of air enriched in oxygen;

liquefying a portion of the nitrogen in the head of the column by vaporizing rich liquid expanded at low pressure in a head condenser (5) of the column;

when the gaseous nitrogen demand is greater than a nominal demand, sending liquid nitrogen to the head of the column from a liquid nitrogen holding tank (7), and storing rich liquid in a rich liquid holding tank (6) connected to the sump of the column as well as to the head condenser; and when the gaseous nitrogen demand is less than the nominal demand, sending liquid nitrogen from the head of the column to the liquid nitrogen holding tank (7) and reducing the level of rich liquid in the rich liquid holding tank (6), wherein the liquid nitrogen is caused to pass from the column (4) to the liquid nitrogen holding tank (7) and vice versa, via a single conduit (12) equipped with a pressure reducing device (13), and the pressures in the liquid nitrogen holding tank (7) and rich liquid holding tank (6) are maintained at constant values.

2. Process according to claim 1, further comprising monitoring (at 24) the purity of the production nitrogen, and correcting said purity if desired by the action of an expansion device (23) for the vaporized rich liquid in the head condenser (5).

3. Installation for producing gaseous nitrogen with variable flow rate and a substantially constant composition, comprising:

means (1) for compressing air;

means (2) for purifying the compressed air of water and $CO_2$;

a rectification column (4) equipped with a head condenser (5) and producing gaseous nitrogen product in the head and a so-called rich liquid in the sump, comprising of air enriched in oxygen;

a heat exchange line (3) for cooling the purified air near to its dewpoint and reheating products leaving the column;

a rich liquid holding tank (6), a first conduit (8) equipped with an expansion valve (9) and connecting the sump of the column to this holding tank, and a second conduit (10) equipped with a expansion valve (11) and connecting the rich liquid holding tank to the head condenser;

a liquid nitrogen holding tank (7), and means for sending liquid nitrogen from the head of the column to this holding tank and vice versa;

a single connecting conduit (12) equipped with a pressure reducing device (13) connecting the head of the column to the liquid nitrogen holding tank (7), and means (14, 16) for maintaining each of the two holding tanks (6, 7) at a constant pressure.

4. Installation according to claim 3, wherein the pressure reducing device (13) is symmetrical relative to the two flow directions in the connecting conduit (12), and is particularly a calibrated orifice, a fixed position manual valve or a venturi.

5. Installation according to claim 4, comprising an adjustable expansion device (23) for the vaporized rich liquid in the head condenser (5), and an analyzer (24) for the purity of the production nitrogen controlling this expansion device.

6. Installation according to claim 4, wherein the pressure reducing device (13) is asymmetrical relative to the two directions of flow of the connecting conduit, and is particularly a convergence followed by a fixed position manual valve.

* * * * *